United States Patent [19]

Martin

[11] 4,363,602

[45] Dec. 14, 1982

[54] COMPOSITE AIR FOIL AND DISC ASSEMBLY

[75] Inventor: Jack R. Martin, Bedford, Mass.

[73] Assignee: General Electric Company, Lynn, Mass.

[21] Appl. No.: 125,063

[22] Filed: Feb. 27, 1980

[51] Int. Cl.[3] ..... F01D 5/34

[52] U.S. Cl. ..... 416/230; 416/241 A

[58] Field of Search ..... 416/218, 230 R, 241 A, 416/244 A, 229 A, 234 A; 415/213 C; 60/200 A

[56] References Cited

U.S. PATENT DOCUMENTS

| | | | |
|---|---|---|---|
| 804,410 | 11/1905 | Keller . | |
| 3,077,297 | 2/1963 | Clarke | 416/229 |
| 3,501,090 | 3/1970 | Stoffer et al. | 416/241 A |
| 3,664,764 | 5/1972 | Davis et al. | 416/230 |
| 3,679,324 | 7/1972 | Stargardter | 416/229 |
| 3,752,600 | 8/1973 | Walsh et al. | 416/241 A |
| 3,943,703 | 3/1976 | Kronogard | 416/214 A |
| 4,040,770 | 8/1977 | Carlson | 416/230 R |

*Primary Examiner*—Leonard E. Smith

*Attorney, Agent, or Firm*—Donald W. Walk; Derek P. Lawrence

[57] ABSTRACT

An integral composite airfoil and disc assembly for use in a turbomachine is provided wherein the assembly includes an airfoil portion having a plurality of axially adjacent first filaments extending in a first direction. The assembly further includes a hub portion having at least one second filament extending in a second direction and a matrix material dispersed between filaments of the first plurality and the second filament. The first and second filaments are disposed so as to extend in the direction of principal stress in the airfoil and disc portions respectively.

6 Claims, 8 Drawing Figures

COMPOSITE AIR FOIL AND DISC ASSEMBLY

The government has rights to this invention pursuant to contract number F33615-79-C-2043 awarded by the Department of the Air Force.

BACKGROUND OF THE INVENTION

This invention relates to a turbo machine and more particularly to an integral composite airfoil and disc assembly useable in the compressor or turbine components associated with such an engine.

For many years, attempts have been made to improve the performance characteristics of airfoils rotating within a gas turbine engine. One general approach provided for the use of composite materials in structuring the airfoil. Typically, this approach uses high strength elongated filaments composited in a light weight matrix. Recent efforts have introduced the use of boron, graphite and other synthetic filaments which have extremely high strength characteristics as well as high module of elasticity for compatibility with stiffness requirements of airfoils. To a large extent, composite airfoils have proven to exhibit performance characteristics equal to or better than airfoils homogenously comprised of metal. Furthermore, composite airfoils have been shown to offer significant weight reductions over conventional airfoils.

However, prior art composite activity has focused primarily, if not solely, upon constructing only the airfoil from a composite material. Specifically, the airfoil, constructed as a discreet component, has been inserted and locked in place in the periphery of a metallic compressor or turbine disc by conventional dovetail tang and dovetail slot arrangements. While acceptable for many applications, these assemblies are not entirely satisfactory where manufacturing costs are an especially significant factor or where stringent performance requirements must be met within restrictions on allowable weight. For these latter applications airfoil and disc assemblies manufactured entirely from composite materials appear to be highly suitable. Additional advantages may be realized if the composite airfoil and disc assemblies are manufactured as an integral unit.

The design and fabrication of a composite integral airfoil and disc assembly presents a number of difficult problems. Particularly, a major consideration involves adapting the unidirectional strength characteristics of composite filaments to the multi-directional stress field exhibited in the airfoil and disc assembly. Generally the matrix material, which is the composite material disposed between filaments, is usually much weaker than the composite filaments themselves. Consequently, orientation of filaments in directions compatible with the stress fields found in the assembly is of paramount importance in the design of the composite integral assembly. Achieving compatible orientation, however, is a difficult task. By way of example, filaments oriented in a direction compatible with the stress field of the airfoil are not usually compatible with the stress field associated with the disc portion of the assembly. Additionally, since each airfoil is displaced angularly from each other airfoil in the assembly, orientation of all the filaments in a direction compatible with the strength characteristics of one airfoil may not be compatible with the stress fields of other airfoils in the assembly. Hence, orientation of the filaments for compatibility with the stress fields of the disc and each airfoil is a significant design objective.

Another problem, which must be addressed during design of an integral composite airfoil and disc assembly, relates to the shear forces induced between layers of composite cloth or plies. In the manufacture of composite articles, high strength filaments are first bundled together in groups of approximately 1,000–10,000 filaments. A first set of bundled filaments are disposed in a first or warp direction (a direction parallel to the length of the cloth) and then interwoven with a second set of bundled filaments disposed in a second or fill direction (generally perpendicular to the warp direction). The resulting weave is commonly referred to cloth, fabric or plies. The composite article is then constructed by arranging one ply atop another ply until sufficient thickness is attained to form the article. A matrix material is then infiltrated into the aggregation of plies and subjected to heat and pressure to form a rigid composite article. The resulting fused article is comprised of layers of filaments between which is disposed matrix material. Loads induced on the article in an operating environment are resisted primarily by the filaments. However, the loads also induce shear forces between layers of cloth which must be resisted by the matrix material in shear. Hence, matching of the shear and strain characteristics of the matrix material with the shear and strain characteristics of the filaments is a significant design objective.

SUMMARY OF THE INVENTION

Accordingly, it is an object of the present invention to provide an integral composite airfoil and disc assembly.

It is another object of the present invention to provide an integral composite blade and disc assembly wherein the filaments associated with the assembly are compatible with the stress fields exhibited both in the disc and each airfoil.

It is still another object of the present invention to provide an integral composite blade and disc assembly wherein the shear and strain characteristics of the matrix material are compatible with the shear and strain characteristics of the filaments in the assembly.

These and other objects which will become apparent from the following detailed description and appended drawings are accomplished by the present invention which, briefly stated, provides in one form, an integral composite airfoil and disc assembly comprising an airfoil portion having a plurality of axially adjacent filaments extending in a first direction and a hub portion disposed radially inward of the airfoil portion and having at least one second filament extending in a second direction. A matrix material is dispersed between filaments of the first plurality and the second filament. The invention may further include at least one gap in the bore portion between axially adjacent first filaments and the second filament, which may be one of a plurality of second filaments, may reside in the gap.

DESCRIPTION OF THE DRAWINGS

While the specification concludes with claims particularly pointing out and distinctly claiming the subject matter hereof, the present invention will be more fully understood from the following description of the preferred embodiment which is given, by way of example, with the accompanying drawings in which:

DESCRIPTION OF THE PREFERRED EMBODIMENT

Figure 1:
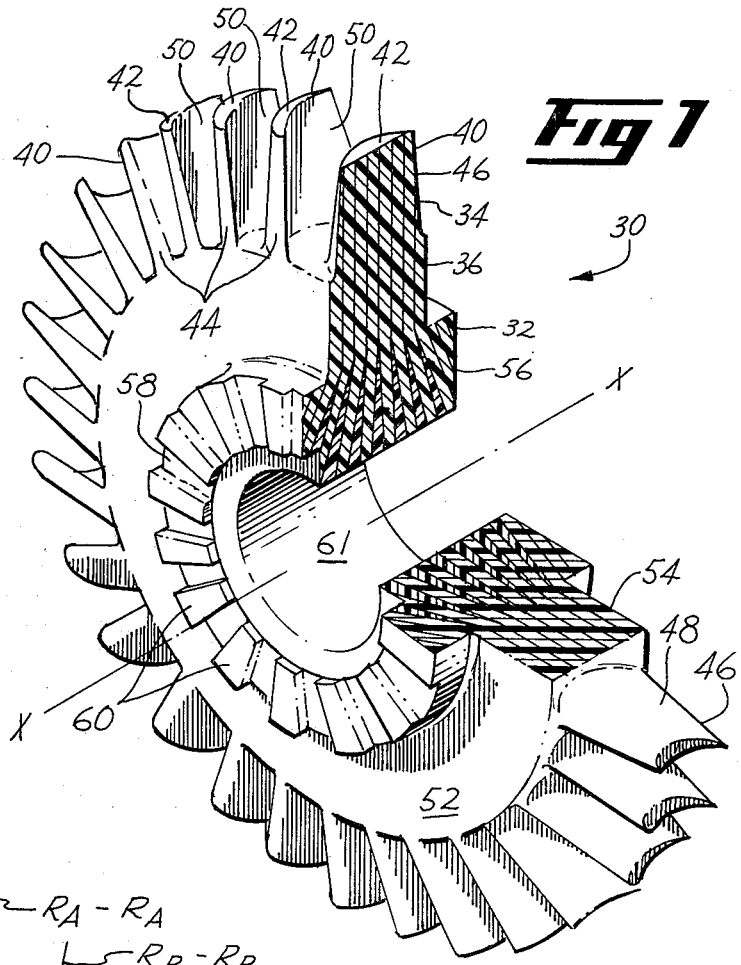
FIG. 1 depicts a schematic partially cut-away perspective view of the airfoil and disc assembly comprising the present invention.

Referring now to the drawings, FIG. 1 depicts a perspective partially cut-away view of a composite airfoil and disc assembly shown generally at 30. Assembly 30 is arranged generally axi-symmetrically about axis X—X and includes a circumferentially and axially extending hub portion 32 disposed radially inwardly of airfoil portion 34. Hub portion 32 and airfoil portion 34, which similarly extends circumferentially and axially with respect to axis X—X, integrally comprise assembly 30; that is to say, assembly 30 is of one-piece or integral construction. As used herein, the term radial direction, or the like, means a direction generally along a radial line emanating from axis X—X. The term axial direction, or the like, means a direction generally along a line parallel to axis X—X. The term circumferential direction or the like means a direction generally along the curved line of a circle symmetrical about the axis X—X.

Airfoil portion 34 is comprised of an annular airfoil base 36, extending radially outward from hub portion 32, and a plurality of radially and axially extending circumferentially spaced-apart airfoils 40. Each airfoil 40 projects radially outwardly from base 36 and terminates in an airfoil tip 42. Each airfoil 40 further includes a radially extending leading edge 44 at one axial end and a radially extending trailing edge 46 at its other axial end. Airfoils 40 each are provided with a pair of opposed circumferentially facing surfaces, namely suction side surface 48 and pressure side surface 50, each of which extend from leading edge 44 to trailing edge 46 and provide the aerodynamic properties of the airfoil 40 in a conventional manner.

Base 36 further includes a pair of circumferentially extending surfaces 52 and 54 facing in opposite axial directions and extending from airfoils 40 to hub portion 32. Hub portion 32 is axially bounded by one circumferentially extending face 56 at one axial end and by a second circumferentially extending face 58 at its other axial end. Face 58 may include a plurality of splines 60 projecting axially therefrom to provide means for effecting an interlocking connection between assembly 30 and other elements of the turbomachine. Hub portion 32 is further bounded at its radially innermost extent by a circumferentially and axially extending inner periphery 61.

Figure 2:
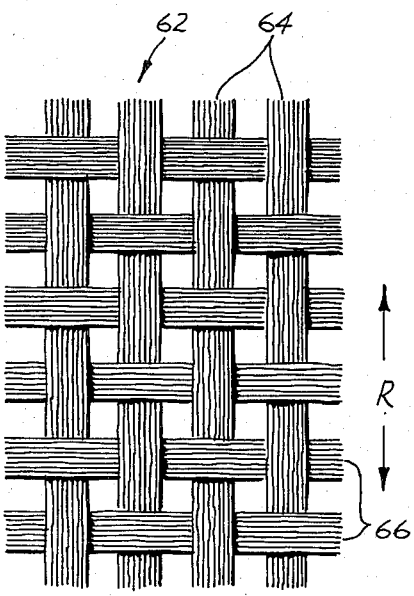
FIG. 2 provides a schematic enlarged view of one ply of woven filament material utilized in the fabrication of the assembly depicted in FIG. 1.
Figure 3:
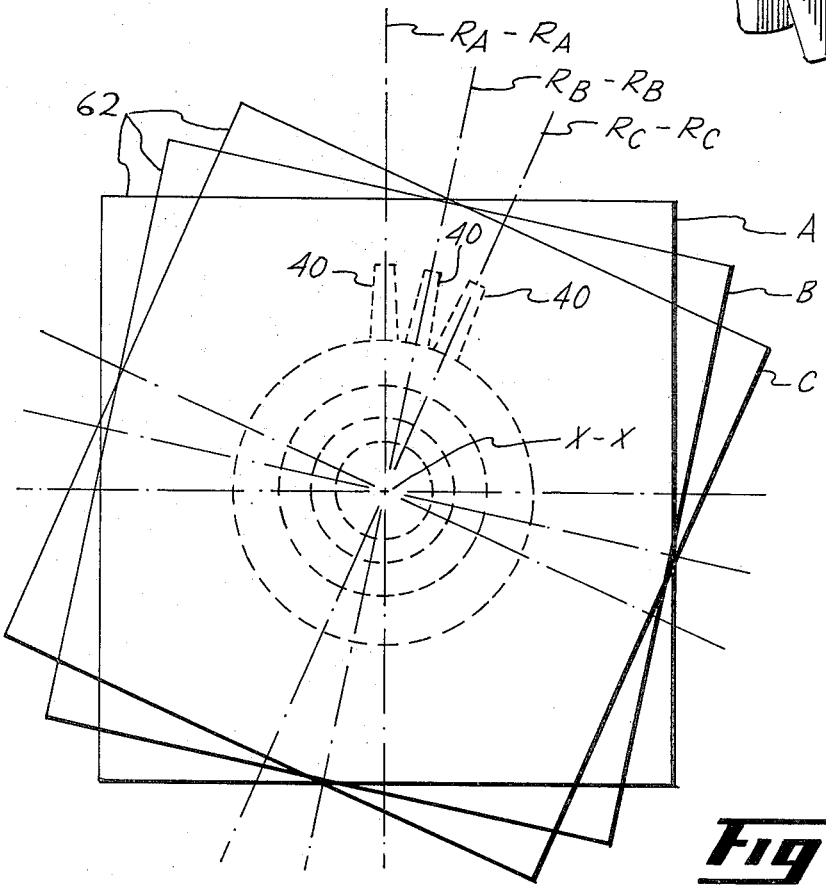
FIG. 3 shows a schematic representation of the orientation of adjacent plies in the assembly depicted in FIG. 1.

Referring now to FIGS. 2 and 3, the detailed construction of assembly 30 will now be described. Assembly 30 is comprised of a first plurality of filamented sheets or plies 62 (one of which is shown in FIG. 2) each having a plurality of elongated first filaments 64 disposed generally parallel to one another. Filaments 64 are grouped together in bundles or rays, comprised of perhaps as many as 10,000 individual filaments 64, and extend in a warp direction R—R generally parallel to the length of the ply. Interwoven amongst filaments 64, bundles of fill filaments 66 extend along a fill direction generally perpendicular to warp direction R—R.

FIG. 3 schematically depicts three adjacent plies of the aforementioned plurality of plies 62 each arranged generally perpendicular to the axis X—X (shown in FIG. 3 as going into the plane of the paper). An end view of assembly 30 is shown by dashed lines in FIG. 3 to assist in illustrating the orientation of plies 62. One ply 62, designated A in FIG. 3, is positioned so that its first filaments 64 extend radially in warp direction $R_A$—$R_A$ in the same radial direction as a line extending from axis X—X and passing through one of the plurality of airfoils 40. Another ply 62, designated B and disposed axially adjacent to ply A, is positioned so that its first filaments 64 extend radially in warp direction $R_B$—$R_B$ in the same radial direction as a line, extending from axis X—X and passing through the next adjacent airfoil 40. A third ply 62, designated C and disposed axially adjacent to ply B, is positioned so that its first filaments 64 extend radially in warp direction $R_C$—$R_C$ in the same radial direction as a line extending from axis X—X and passing through the next adjacent airfoil 40. While only three plies have been depicted in FIG. 3, it should be understood that assembly 30 is comprised of a very large plurality of plies 62 each of which bears the same relationship with adjacent plies as just described for plies A, B, and C.

From the foregoing, it is observed that the warp directions of plies 62 are angularly offset from each other by an angle equal to 360° divided by the number of airfoils 40 in the same assembly 30. Oriented in this manner, each ply 62 will have its filaments 64 passing through one of the plurality of airfoils 40 and extending in the direction of principal stress. Since composite filamented materials exhibit excellent strength characteristics primarily in the direction of elongation or orientation of the filaments, each airfoil then is provided with properly oriented filaments which give the airfoil excellent strength characteristics and stress sustaining capability in the direction of principal loading on the airfoil. Furthermore, offsetting of the plies 62 in the manner described gives each airfoil 40 substantially the same strength/stress capabilities as other of the airfoils 40. This result would not obtain, it should be noted, if each ply 62 were oriented in the same warp direction or randomly oriented.

Figure 4:
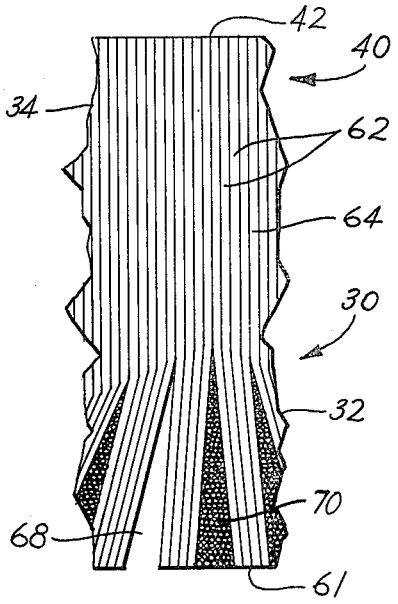
FIG. 4 depicts a schematic enlarged view of a portion of the assembly shown in FIG. 1.

FIG. 4 schematically depicts an enlarged view of a portion of plies 62 taken in a circumferential cross-section from which a better understanding of the orientation of plies 62 in assembly 30 may be obtained. Referring then to FIG. 4 in conjunction with FIG. 1, plies 62 extend from the tips 42 of airfoils 40 to the radially inner periphery 61 of hub portion 32. Hence, filaments 64, associated with each ply 62, extend from inner periphery 61 to tips 42.

In airfoil portion 34, each of plies 62 are disposed, as heretofore described, immediately axially adjacent to another of plies 62. However, in hub portion 32 axially adjacent plies 62, and hence selected axially adjacent filaments 64, splay axially apart from each other to provide a plurality of axially spaced apart annular gaps 68 between plies 62 in bore portion 32. Gaps 68, between selected adjacent plies 62 are wedged-shaped in circumferential cross-section and, accordingly, the cross-section increases in axial width in the radially inward direction.

As stated previously, the loadings on airfoils 40 from the gases flowing in the turbomachine result in principal stresses in a direction along a radial line from axis X—X toward airfoils 40. In hub portion 32, the principal loads result in stresses in the circumferential direction. These stresses, which are essentially perpendicular to filaments 64, are commonly referred to as hoop stresses. Accordingly, filaments 64 are not well adapted to bear the loads in hub portion 32. To accommodate these loads and stress distributions, a plurality of annular composite inserts 70 are provided. Each insert 70 resides in one of the gaps 68 in bore portion 32.

Figure 5:
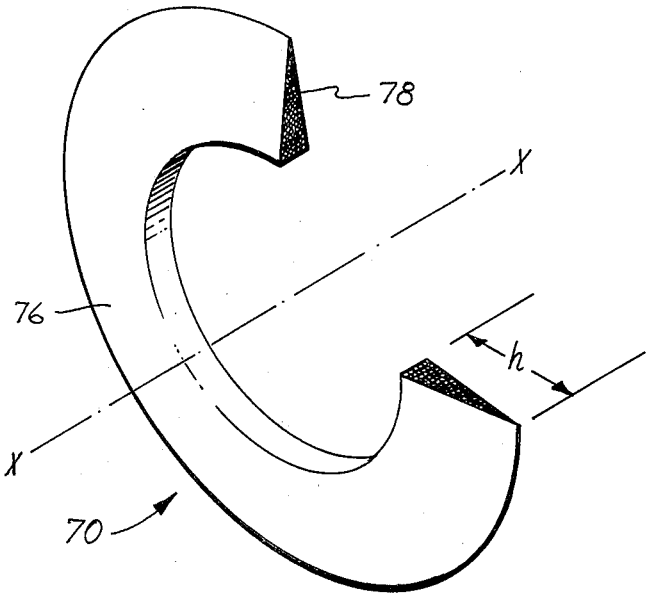
FIG. 5 shows a schematic partially cut-away perspective view of the inserts associated with the assembly depicted in FIG. 1.
Figure 6:
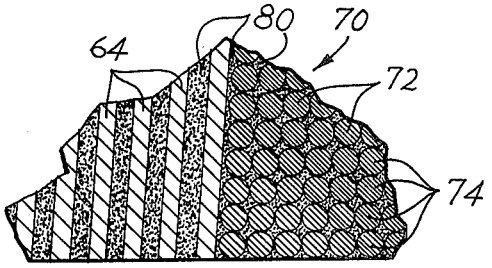
FIG. 6 provides an enlarged schematic view of the interface between filaments comprising a portion of the assembly depicted in FIG. 4.

Referring now to FIGS. 5 and 6, there is respectively depicted a partially cut-away perspective view of one insert 70 and an enlarged schematic cross-sectional view of the interface between filaments 64 and one insert 70. Inserts 70 each include a second plurality of filamented plies 72. Each ply 72 of the plurality is disposed immediately adjacent and radially outward of a next adjacent ply 72 of the plurality. Said another way, the plies 72 are stacked one upon the other in the radial direction. Each ply 72 is comprised of at least one second filament 74 extending in a direction circumferential about axis X—X. While in one preferred embodiment a single filament 74 may be continuously wound repeatedly about axis X—X to form insert 70, it is also preferred to use a plurality of discreet second filaments 74 to form insert 70. Since, in either embodiment, the filaments 74 extend in the circumferential direction, inserts 70 are each well adapted to withstand the aforementioned hoop stresses arising in hub portion 32 of assembly 30.

Matrix material 80 is interspersed or infiltrated between filaments 64 in plies 62, between filaments 74 of inserts 70 and between inserts 70 and plies 62. Matrix material 80 infiltrates the voids between each of the aforesaid filaments and serves to bond the filaments together. While the filaments 64 and 74 bear substantially all of the loads on assembly 30, matrix material 80 gives overall structural integrity to assembly 30.

Inserts 70 are tapered or wedge-shaped in circumferential cross-section, and accordingly, the cross-section increases in the radially inward direction. Hence, inserts 70 are configured to be complementary in cross-section to gaps 68 in which inserts 70 reside. It is further observed that circumferentially extending and axially facing surfaces 76 and 78, which are the surfaces of insert 70 that interface with filaments 64, do not extend precisely in a radial direction but, rather, each slopes away from a radial plane perpendicular to the axis X—X. Consequently, for a given radial height of insert 70, the surface area of surfaces 76 and 78 is greater than if insert 70 were untapered.

Tapering inserts 70 as aforedescribed affords a greater surface area over which shear forces between plies 62 and inserts 70 are transmitted. Matrix material 80, disposed between inserts 70 and plies 62 and typically having limited strength in shear as compared to the shear strength of the filaments 64 and 74, transmits loads between inserts 70 and plies 62 in a shear mode. Tapering of inserts 70 provides a greater interface area over which shear forces are transmitted and consequently the shear forces per unit area in matrix material 80 are lower. Hence, the matrix material 80 is better adapted to transmit loads between inserts 70 and plies 62. While gaps 68 and inserts 70 have been depicted as wedge-shaped in circumferential cross-section, other non-constant width cross-sectional configurations are equally adapted to effect reduced shear stresses in matrix material 80. The particular cross-sectional configuration selected for a specific application will depend upon the loads the assembly 30 must withstand in the environment of the turbomachine, the stress and strain characteristics of the filaments 64 and 74, and the stress and strain characteristics of the matrix material 80. Essentially the use of a nonconstant cross-sectional area permits the stress and strain characteristics of the filaments 64 and 74 to be effectively matched or made compatible to the stress and strain characteristics of the matrix material 80.

The assembly 30 is fabricated by first stacking the plurality of plies 62 one upon the other in the axial direction and with an orientation with respect to one another as hereinbefore described. During this procedure inserts 70 are positioned in gaps 68 formed when selected of plies 62 are splayed apart in hub portion 32. Matrix material is then infiltrated into assembly 30 so as to intersperse into the voids between filaments 64 in plies 62, the voids between filaments 74 in plies 72 and the voids between filaments 64 and filaments 74. Upon the application of heat and pressure, the matrix material 80 reacts to form a bond between filaments 64, a bond between filaments 74, and a bond between filaments 64 and 74. At this juncture in the fabrication process, assembly 30 is in a solid cylindrical billet form. The billet is then subsequently machined to remove material therefrom so as to form airfoils 40, inner periphery 61 of hub portion and other external surfaces of assembly 30.

Turbomachines such as gas turbine engines associated with missile systems are particularly receptive to use therein of the aforedescribed airfoil and disc assembly. The mission requirements of these missile systems permit the use of small gas turbine engines that have short component lifes. Since these engines are small, turbine inlet temperatures are high to provide required power output and turbines constructed of conventional metallic alloys require more cooling. However, it is virtually impossible, to provide cooling passages in these airfoils large enough to meet cooling requirements. However, airfoils and discs comprised of a high strength composite material do not require cooling to be resistant to degradation in a high temperature environment and, thereofore, are particularly adaptable for use in turbines of this type. One particularly suitable material is commonly referred to as carbon-carbon material in which high strength carbon filaments, having 400,000 to 500,000 psi typical fiber strength and a very low density relative to conventional turbine alloys, are supported in a matrix of carbon. Hence, use of filaments 64 and 74 comprised of these high strength carbon filaments and use of a matrix material 80 comprised of carbon provide an airfoil and disc assembly 30 well suited for use in the turbine section of a gas turbine engine associated with a missile system.

Figure 7:
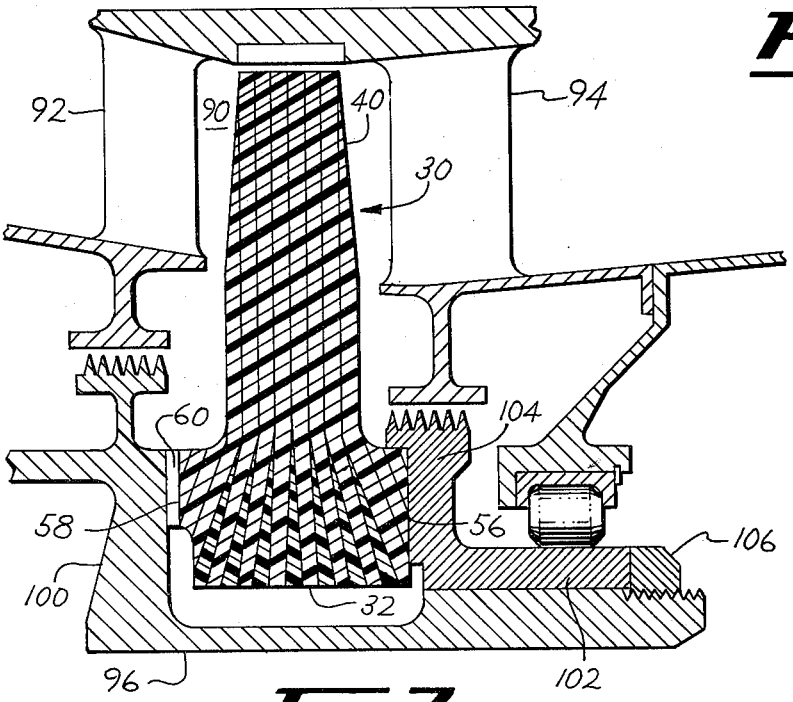
FIG. 7 depicts the assembly comprising the present invention disposed within a turbine section of a typical gas turbine engine.

Referring now to FIG. 7, which depicts assembly 30 associated with other components of the turbine section in a turbomachine, assembly 30 is disposed with airfoils 40 projecting into flowpath 90 between first and second rows of nozzle vanes 92 and 94 respectively. Assembly 30 projects radially inwardly from flowpath 90 whereby hub portion 32 is disposed adjacent an axially extending rotatable drive shaft 96. Splines 60 on hub face 58 engage complementary splines on a first portion 100 of drive shaft 96. Assembly 30 is retained in engagement with shaft 96 by sleeve 102 which includes a flange portion 104 in engagement with axial face 56 of hub portion 32. Sleeve 102 is held in engagement with hub portion 32 by nut 106 threaded onto shaft 96. Tightening of nut 106 on shaft 96 creates an axial clamping load on hub portion 32. The clamp load increases the load bearing capability of assembly 30 by increasing the shear strength of hub portion 32. Hence, means are provided for applying an axial clamping load to assembly 30 proximate hub portion 32.

Figure 8:
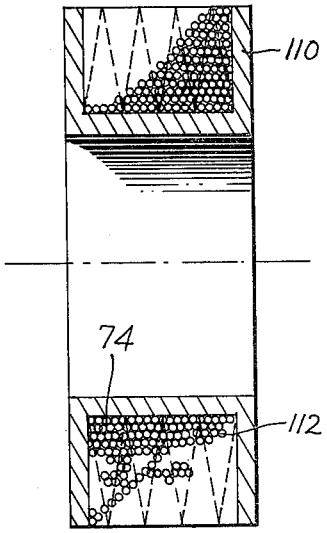
FIG. 8 shows the insert depicted in FIG. 5 during one of its steps of manufacture.

Referring now to FIG. 8, one method of fabricating insert 70 will now be illustrated. An annular channel 110 is provided having a U-shaped circumferential cross-sectional configuration defining an annular recess 112. Recess 112 is filled with a wound filament 74 by continuously winding filament 74 until a sufficient number of plies 72 have been stacked radially to fill recess 112. Matrix material 80 is then at least partially infiltrated into the voids between filaments 74 and then subjected to heat and pressure to form a self-supporting structure. Channel 110 is then removed and the rigid structure is then machined into a plurality of discreet inserts 70 each having a wedge-shaped cross-section (shown as dashed lines in FIG. 8).

From the foregoing, it is now apparent that the embodiments of the invention herein described are well adapted to fulfill the aforestated objects and that while these embodiments have been described for purposes of illustration, it is understood that other equivalent forms of the present invention are possible within the scope of the appended claims.

Having thus described the invention, what is claimed as new and useful and desired to be secured by U.S. Letters Patent is:

1. For use in a turbomachine, an integral composite airfoil and disc assembly adapted for rotation about an axis said assembly including a radially outer airfoil portion having a plurality of generally radially and axially extending circumferentially spaced-apart airfoils and a bore portion disposed radially inward of said airfoil portion, the invention comprising:

a first plurality of filamented plies comprising said airfoil portion and said bore portion, said plies including a plurality of first filaments comprising one of said airfoils and disposed generally parallel to a radial line emanating perpendicularly from said axis, said plies disposed axially adjacent each other in said airfoil portion, at least two adjacent plies splaying in said bore portion axially away from each other providing in said bore portion an axial gap between said splayed apart adjacent plies;

a second plurality of filamented plies disposed in said gap, said second plurality of plies including a second filament oriented to extend generally in a direction circumferential about said axis, and wherein said axial gap between said adjacent plies increases in axial width in the radially inward direction and said second plurality of plies has axial cross-sectional width which increases in the radially inward direction; and a matrix material interspersed between said first plurality of filament plies and said second filament.

2. For use in a turbomachine, an integral composite airfoil and disc assembly adapted for rotation about an axis said assembly including a radially outer airfoil portion having a plurality of generally radially and axially extending circumferentially spaced-apart airfoils and a bore portion disposed radially inward of said airfoil portion, the invention comprising:

a first plurality of filamented plies comprising said airfoil portion and said bore portion, said plies including a plurality of first filaments comprising one of said airfoils and disposed generally parallel to a radial line emanating perpendicularly from said axis, said plies disposed axially adjacent each other in said airfoil portion, at least two adjacent plies splaying in said bore portion axially away from each other providing in said bore portion a gap between said splayed apart adjacent plies;

a second plurality of filamented plies disposed in said gap, said second plurality of plies including a second filament oriented to extend generally in a direction circumferential about said axis;

a matrix material interspersed between said first plurality of filament plies and said second filament; and wherein each of said airfoils is comprised of each of said plies in said first plurality of plies and said plurality of first filaments in one of said plies is disposed at an angle with said first filaments in other of said plies, said angle being essentially equal to a whole number multiple of 360° divided by the number of airfoils in said airfoil portion.

3. For use in a turbomachine, an integral composite airfoil and disc assembly adapted for rotation about an axis said assembly including a radially outer airfoil portion having a plurality of generally radially and axially extending circumferentially spaced-apart airfoils and a bore portion disposed radially inward of said airfoil portion, the invention comprising:

a first plurality of filamented plies comprising said airfoil portion and said bore portion, said plies including a plurality of first filaments comprising one of said airfoils and disposed generally parallel to a radial line emanating perpendicularly from said axis, said plies disposed axially adjacent each other in said airfoil portion, at least two adjacent plies splaying in said bore portion axially away from each other providing in said bore portion a gap between said splayed apart adjacent plies;

a second plurality of filamented plies disposed in said gap, said second plurality of plies including a second filament oriented to extend generally in a direction circumferential about said axis;

a matrix material interspersed between said first plurality of filament plies and said second filament; and means for applying an axial clamping load to said assembly proximate said bore portion.

4. For use in turbo machinery having an integral composite airfoil and disc assembly adapted for rotation about an axis, said assembly including a radially outer airfoil portion having a plurality of generally radially and axially extending circumferentially spaced-apart airfoils and a bore portion disposed radially inward of said airfoil portion, the invention comprising:

a first plurality of filamented plies comprising said airfoil portion and said bore portion, each of said plies including a plurality of first filaments comprising a portion of one of said airfoils dispersed generally parallel to a radial line emanating perpendicularly from said axis, said plies disposed axially adjacent each other in said airfoil portion;

a plurality of axially spaced-apart annular gaps disposed in said bore portion between said plies of said first plurality;

a plurality of annular inserts, each insert including a second plurality of filamented plies comprising said bore portion, each of said inserts disposed in one of said gaps, each of said plies in said second plurality including a plurality of second filaments extending circumferentially about said axis;

a matrix material interspersed between said first filaments and said second filaments; and wherein said gaps between said plies are comprised of a cross-section having a wedge-shaped configuration and said inserts are comprised of a cross-section having a wedge-shaped configuration.

5. For use in turbo machinery having an integral composite airfoil and disc assembly adapted for rotation about an axis, said assembly including a radially outer airfoil portion having a plurality of generally radially and axially extending circumferentially spaced-apart airfoils and a bore portion disposed radially inward of said airfoil portion, the invention comprising:

a first plurality of filamented plies comprising said airfoil portion and said bore portion, each of said plies including a plurality of first filaments comprising a portion of one of said airfoils disposed generally parallel to a radial line emanating perpendicularly from said axis, said plies disposed axially adjacent each other in said airfoil portion;

a plurality of axially spaced-apart annular gaps disposed in said bore portion between said plies of said first plurality;

a plurality of annular inserts, each insert including a second plurality of filamented plies comprising said bore portion, each of said inserts disposed in one of said gaps, each of said plies in said second plurality including a plurality of second filaments extending circumferentially about said axis;

a matrix material interspersed between said first filaments and said second filaments; and wherein each of said airfoils is comprised of each of said plies in said first plurality of plies and said plurality of first filaments in one of said plies is disposed at an angle with said first filaments in other of said plies, said angle being essentially equal to a whole number multiple of 360° divided by the number of airfoils in said airfoil portion.

6. For use in turbo machinery having an integral composite airfoil and disc assembly adapted for rotation about an axis, said assembly including a radially outer airfoil portion having a plurality of generally radially and axially extending circumferentially spaced-apart airfoils and a bore portion disposed radially inward of said airfoil portion, the invention comprising:

a first plurality of filamented plies comprising said airfoil portion and said bore portion, each of said plies including a plurality of first filaments comprising a portion of one of said airfoils disposed generally parallel to a radial line emanating perpendicularly from said axis, said plies disposed axially adjacent each other in said airfoil portion;

a plurality of axially spaced-apart annular gaps disposed in said bore portion between said plies of said first plurality;

a plurality of annular inserts, each insert including a second plurality of filamented plies comprising said bore portion, each of said inserts disposed in one of said gaps, each of said plies in said second plurality including a plurality of second filaments extending circumferentially about said axis;

a matrix material interspersed between said first filaments and said second filaments; and means for applying an axial clamping load to said assembly proximate said bore portion.

* * * * *